US008661846B2

(12) United States Patent
Lifson et al.

(10) Patent No.: US 8,661,846 B2
(45) Date of Patent: Mar. 4, 2014

(54) RESTRICTION IN VAPOR INJECTION LINE

(75) Inventors: Alexander Lifson, Manilus, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 1553 days.

(21) Appl. No.: 11/915,412

(22) PCT Filed: May 31, 2005

(86) PCT No.: PCT/US2005/019048

§ 371 (c)(1),
(2), (4) Date: Nov. 26, 2007

(87) PCT Pub. No.: WO2006/130137

PCT Pub. Date: Dec. 7, 2006

(65) Prior Publication Data

US 2008/0209922 A1 Sep. 4, 2008

(51) Int. Cl.
*F25B 41/00* (2006.01)

(52) U.S. Cl.
USPC ..... 62/513

(58) Field of Classification Search
USPC ..... 62/513
See application file for complete search history.

(56) References Cited

U.S. PATENT DOCUMENTS 4,787,211 A 11/1988 Shaw
5,095,712 A * 3/1992 Narreau ..... 62/113
5,768,901 A 6/1998 Dormer et al.
5,979,780 A * 11/1999 Malone et al. ..... 236/92 B
6,047,556 A * 4/2000 Lifson ..... 62/196.2
6,058,729 A 5/2000 Lifson et al.
6,138,467 A * 10/2000 Lifson et al. ..... 62/217
6,202,438 B1 * 3/2001 Barito ..... 62/513
6,276,148 B1 * 8/2001 Shaw ..... 62/117
6,374,631 B1 4/2002 Lifson
6,474,087 B1 * 11/2002 Lifson ..... 62/199
6,571,576 B1 6/2003 Lifson
2004/0206110 A1 10/2004 Lifson

FOREIGN PATENT DOCUMENTS

EP 921364 A2 6/1999
EP 981033 A2 2/2000

OTHER PUBLICATIONS

International Search Report and Written Opinion dated Apr. 7, 2008.
Supplementary European Search Report, dated Mar. 22, 2011.

* cited by examiner

*Primary Examiner* — Allen Flanigan
*Assistant Examiner* — Filip Zec
(74) *Attorney, Agent, or Firm* — Carlson, Gaskey & Olds

(57) ABSTRACT

A refrigerant system can be operated in either vapor injection mode or unloaded mode. A restriction to the vapor injection flow is incorporated into the refrigerant system. The restriction is placed on the vapor injection line upstream of a point where the injection line meets the unloader line. In this case, the flow is restricted for the vapor injection mode of operation to a desired level. However, when the refrigerant system operates in the unloaded mode, there is no restriction to the by-pass flow, which is beneficial to the system performance in this mode of operation. In one of the embodiments, the restriction area can be adjusted to achieve the best performance during the vapor injection mode of operation in relation to the operating conditions.

13 Claims, 1 Drawing Sheet

RESTRICTION IN VAPOR INJECTION LINE

BACKGROUND OF THE INVENTION

This application relates to a refrigerant system wherein a single line leading into the compressor provides both the unloader function and the economizer or so-called vapor injection function, and wherein a restriction is placed on the economizer injection line at a location such that the unloader function is not affected.

Refrigerant systems are utilized to control the temperature and humidity of air in various indoor environments to be conditioned. In a typical refrigerant system operating in a cooling mode, a refrigerant is compressed in a compressor and delivered to a condenser (or an outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools and typically dehumidifies the air that is being supplied to the indoor environment.

One of the options available to a refrigerant system designer to enhance the system performance is a so-called economizer cycle. In the economizer cycle, a portion of the refrigerant flowing from the condenser is tapped and passed through an economizer expansion device and then to an economizer heat exchanger. This tapped refrigerant subcools a main refrigerant flow that also passes through the economizer heat exchanger. The tapped refrigerant leaves the economizer heat exchanger, usually in a vapor state, and is injected back into the compressor at an intermediate compression point. The main refrigerant is additionally subcooled after passing through the economizer heat exchanger. The main refrigerant then passes through a main expansion device and an evaporator. This main refrigerant flow will have a higher cooling potential due to additional subcooling obtained in the economizer heat exchanger. The economizer cycle thus provides enhanced system performance. In an alternate arrangement, a portion of the refrigerant is tapped and passed through the economizer expansion device after being passed through the economizer heat exchanger (along with the main flow). In all other aspects this arrangement is identical to the configuration described above.

Recently, the assignee of the present invention has developed a compressor wherein the economizer injection port in the compressor is also utilized to provide the unloader function. An unloader line contains an unloader or bypass valve, and selectively communicates fluid from compression chambers into a suction line. Since the unloader line communicates with the intermediate compression chambers, the effect is to allow partially compressed refrigerant from these compression chambers to pass through the same injection ports and then back to suction. This action is taken to reduce capacity of the refrigerant system. This invention has many benefits, not the least of which are the elimination of separate fluid lines for each of the two functions and utilization of a single intermediate compressor port.

However, this invention has not provided as much flexibility in design as would be desirable. In particular, often the most efficient operation for the economizer function is when the fluid is injected into the intermediate compression pockets while the injection port being of a fairly small size. For this mode of operation, when the fluid is injected into the intermediate compression pockets, if the injection ports were larger then needed, then additional losses would occur, as the refrigerant would be allowed to move in and out of the compression pockets during the injection process. This undesirable movement of the refrigerant introduces additional so-called "sloshing" losses. These "sloshing" losses can reduce the efficiency of the economizer cycle. In other words, if the injection ports are too large for the injection process then there is not enough flow impedance placed in the injection port for optimum operation.

On the other hand, when the unloading mode is engaged its effectiveness is increased when the size of the port is selected to be as large as practically possible. In other words, one needs to reduce the amount of flow restriction in this unloaded mode as much as practically possible for most efficient operation in this mode. Therefore, for optimum operation, one needs different flow restrictions for vapor injection mode and for the unloaded mode. In the past, however, since the restriction was located in the same passage for both economized (vapor injection mode) and unloaded mode, the flow impedance was identical for both economized (vapor injection) and unloaded modes of operation. Therefore, it would be desirable to remove this constraint of having the same fluid restriction for both modes of operation. If this constraint is removed, then one can optimize the size of restriction for the economized operation, while at the same time make the flow as unrestricted as possible for the unloaded operation. In this case, one can substantially improve the cycle efficiency in both economized and unloaded modes.

Thus, the prior art, as for example described in U.S. Pat. No. 5,996,364 and United States pending application 20040184932, which utilize the same injection ports (that serve as a restriction) located in the common passage for both economized and unloaded function, could not fully achieve a desired result.

SUMMARY OF THE INVENTION

In disclosed embodiments of this invention, a restriction is placed in the economizer injection line at a location directly upstream of the location where the unloader line is connected into the economizer injection line (the definition of upstream in this case relates to a situation when the flow is injected into the intermediate compression pockets). Stated more broadly, the restriction is at a location such that in the unloaded mode of operation a portion of partially compressed refrigerant passing from an intermediate compression point within the compressor back to suction does not pass through this restriction on its way to the suction line.

However, in this invention, opposite to the unloaded mode of operation, when the refrigerant is injected into the intermediate compression pocket, the refrigerant must pass through this restriction. The optimum size of the restriction would vary depending on many factors including the compressor displacement, operating frequency, the size, and location of other restrictive elements to the injection flow within the compressor, etc. However the analysis and experiments indicate that the optimum size (area) for the restriction would be on the order of 2 to 15 $mm^2$ for a compressor having 100,000 $mm^3$ displacement and operating at a nominal frequency of 60 Hz. The optimal restriction size (area) for the economized mode of operation would grow roughly in proportion to the compressor displacement and operating frequency. Of course, other sizes would come within the scope of this invention.

In another aspect of the invention, the economizer injection line restriction is made adjustable to accommodate optimal operation over a wide spectrum of operating conditions.

These and other features of the present invention can be best understood from the following specification and drawings, the following of which is a brief description.

DETAILED DESCRIPTION OF THE PREFERRED EMBODIMENT

Figure 1:
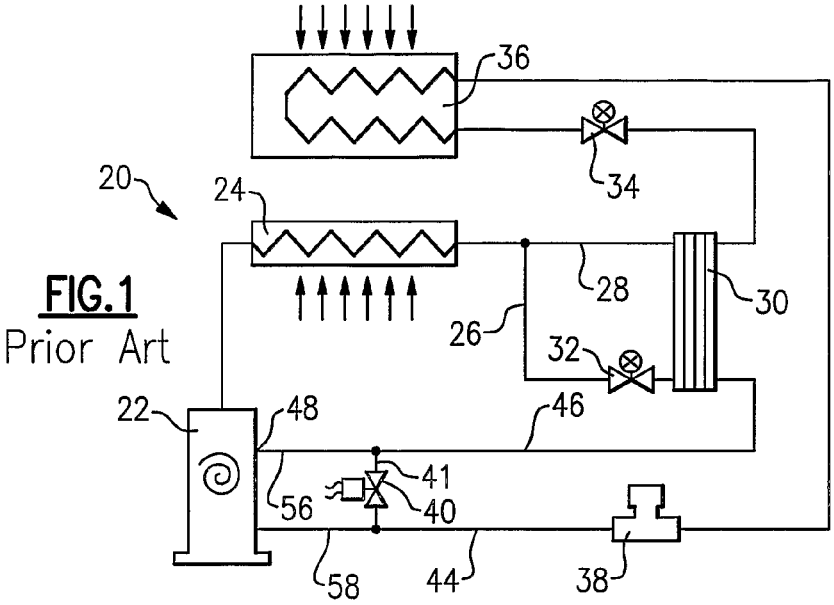
FIG.1 Prior Art
FIG. 1 is a prior art schematic.

A prior art refrigerant system 20 is illustrated in FIG. 1 having a compressor 22 delivering refrigerant to a condenser 24. The compressor can be a scroll, screw, reciprocating, rotary, or any other compressor, that as known has been used in economizer cycles and having an intermediate vapor injection port and by-pass unloading line. A tap line 26 taps refrigerant from a main refrigerant flow line 28 downstream of the condenser. Both the tap line 26 and the main flow line 28 pass through the economizer heat exchanger 30. The tap line passes through an economizer expansion device 32 before reaching the economizer heat exchanger 30. In practice, it may be desirable to pass the two refrigerant flows in counterflow relationship through the economizer heat exchanger 30, although for illustration purposes, the refrigerant streams are shown flowing in the same direction. Also, as known, a flash tank can be utilized in place of the economizer heat exchanger 30. The flash tank operates in a similar fashion and serves a similar function as the economizer heat exchanger described above. It should be understood that for the purposes of this invention, a conventional economizer heat exchanger is illustrated only as a representative example.

Downstream of the economizer heat exchanger 30, the main refrigerant flow passes through an expansion device 34, and to an evaporator 36. Downstream of the evaporator 36 there is an optional suction modulation valve 38 connected to the suction port of the compressor 22 through a line 44 and then suction line 58. When the unloader valve 40 is open and the flow of refrigerant to a vapor injection line 46 is shut off, for example, by closing the economizer expansion device 32, then the system operates in the unloaded mode. During the unloaded mode of operation, the refrigerant passes through the injection port or ports that are normally located internal to the compressor 22, as described in detail in U.S. Pat. No. 5,996,364 and United States pending application 20040184932. After the by-passed refrigerant leaves the compressor it enters the connecting line 41 and then enters the suction line 58 where it mixes with refrigerant from the line 44. The suction line 58 as known returns the refrigerant to the suction side of compressor 22.

When it is desired to have an economizer function, tapped refrigerant is passed through the line 26, and then into the dedicated injection line 46. The refrigerant then flows into the connector line 56 that can serve a dual function of passing the bypass flow and injecting an injection flow, depending on the mode of operation. After the refrigerant enters the connector line 56 during the injection mode, it passes through the intermediate compression entry point 48 and then into the compression chambers of the compressor 22. If it is not desired to have an economizer function, then some shut-off means are enclosed on the line 26 or line 46. As an example, the economizer expansion device 32 can perform a shut-off valve function, or alternatively a separate shut-off valve could be provided.

As mentioned above, one concern with this prior art system is that it would be desirable to have separate design control over the size of the flow restriction for the economizer function and the unloader function. To date, the prior art has not achieved this separate control.

Figure 2:
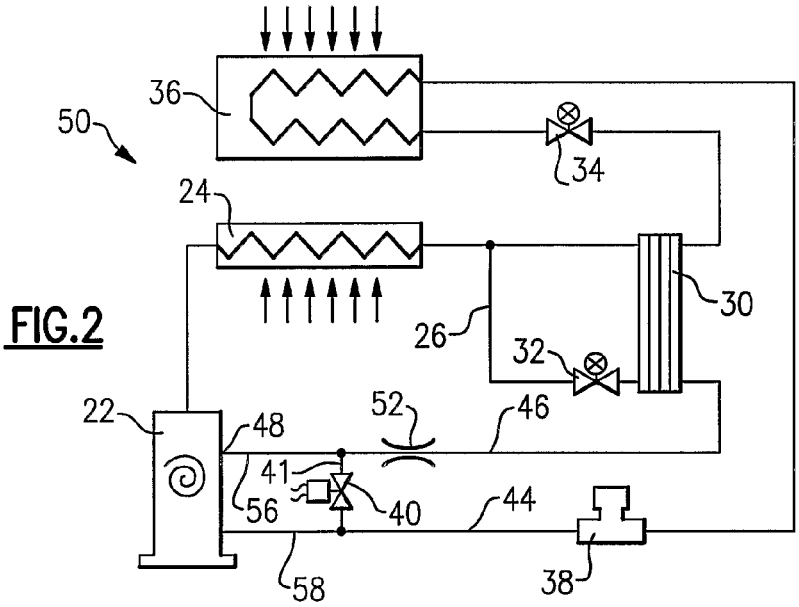
FIG. 2 shows the inventive system.

FIG. 2 shows an embodiment 50 wherein a restriction 52 is placed on the line 46, preferably immediately upstream (as relates to the injection flow) of a T-connection for the lines 41, 46 and 56. Further, the most preferred location will be within 30 cm from this junction. By placing the restriction close to the junction, the "sloshing" losses described above can be minimized. Of course, other distances in placing this restriction will also come within the scope of this invention. Now, by properly sizing the restriction 52, the compressor designer can achieve desired refrigerant flow characteristics for the economizer function (i.e., relatively small flow passage through the restriction 52) while still maintaining a large flow area for the unloader function. Within this configuration, it becomes beneficial to maximize the size of the line 56 and any passages internal to the compressor 22. By maximizing the size of these passages, one can minimize the resistance to the by-pass flow in the unloaded mode of operation, thus improving the efficiency of compressor in this mode of operation. The size of the restriction 52 on the line 46 then can become a controlling restriction for the injection flow.

Figure 3:
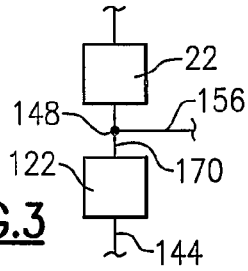
FIG. 3 shows an alternative embodiment.

As shown in FIG. 3, while the intermediate compression point may be within a single compressor as is known, an intermediate compression point 148 could also be defined between two independent compression stages 22 and 122 of a combined compression system. Each independent compression stage can be a separate compressor. Where a line 170 is the line connecting a low-pressure stage compressor to a high-pressure stage compressor. A suction line 144 would receive the by-pass flow as the line 44 does in the FIG. 2, where a line 156 transfers this flow as the line 56 does in FIG. 2 embodiment. Other than utilizing two separate compression stages, this embodiment would be identical to the FIG. 2 embodiment.

Figure 4:
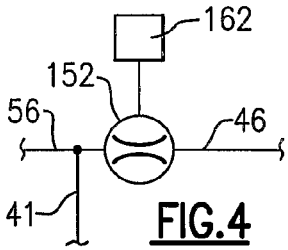
FIG. 4 shows an alternate embodiment where the restriction has a variable opening.

It should be understood that in the context of this invention the restriction 52 of FIG. 2 can be substituted with a variable size restriction of 152 of FIG. 4 where the a variable size restriction opening area can be adjusted during an economized mode of operation to further optimize system performance in this mode in relation to various operating conditions. The size of the restriction can be controlled by a controller 162 that determines the most optimum restriction size based on the operating conditions. Such controls are known, although they have not been utilized at the inventive location, or for the inventive function. Also, a worker of ordinary skill would recognize how to determine an optimum restriction size in relation to operating conditions.

Although preferred embodiments of this invention have been disclosed, a worker of ordinary skill in this art would recognize that certain modifications would come within the scope of this invention. For that reason, the following claims should be studied to determine the true scope and content of this invention.

The invention claimed is:

1. A refrigerant system comprising:

a compressor, said compressor delivering refrigerant to a condenser, a tap line downstream of said condenser tapping a refrigerant from a main refrigerant flow line, said main refrigerant flow line passing through an economizer heat exchanger, said main refrigerant flow line passing from said economizer heat exchanger to an expansion device, and to an evaporator, and, then returning through a suction line back to said compressor, said tapped refrigerant selectively passing through said economizer heat exchanger, and into an economizer injection line to be returned to an intermediate compression point of said compressor through a connector line connecting the injection line to said intermediate compression point, and including an economizer shut-off device, said economizer device selectively allowing or blocking flow of said tapped refrigerant to said compressor;

a partially compressed fluid from said intermediate compression point of said compressor being selectively communicated through said connector line and then through an unloader line to said suction line by an unloader valve placed on said unloader line;

a restriction placed on said economizer injection line at a location such that refrigerant passing through said unloader line does not pass through said restriction but said tapped refrigerant returned to said intermediate compression point will pass through said restriction; and said restriction being placed downstream of said economizer shut-off device.

2. The refrigerant system as set forth in claim 1, wherein said restriction is placed on said economizer injection line no more than 30 cm upstream in relation to the injected fluid of a point wherein said unloader line connects to said economizer injection line.

3. The refrigerant system as set forth in claim 1, wherein said restriction is sized to be approximately 3 $mm^2$ for a compressor having a displacement volume of approximately 100,000 $mm^3$.

4. The refrigerant system as set forth in claim 1, wherein said compressor is a scroll compressor.

5. The refrigerant system as set forth in claim 1, wherein said compressor is a screw compressor.

6. The refrigerant system as set forth in claim 1, wherein said compressor is a reciprocating compressor.

7. The refrigerant system as set forth in claim 1, wherein said compressor is a rotary compressor.

8. The refrigerant system as set forth in claim 1, wherein said compressor has a single compression stage.

9. The refrigerant system as set forth in claim 1, wherein said compressor consists of at least two compressors connected in series, and said intermediate compression point is located on a line connecting any of these two compressors.

10. The refrigerant system as set forth in claim 1, wherein said compressor has two compression stages, and said intermediate compressor point is positioned intermediate of said two compressor stages.

11. The refrigerant system as set forth in claim 1, wherein said restriction has a varying flow area.

12. The refrigerant system as set forth in claim 1, wherein said economizer shut-off device is also an expansion device.

13. The refrigerant system as set forth in claim 12, wherein said economizer shut-off device is positioned to be upstream of said economizer heat exchanger on said tap line.

* * * * *